US006403296B1

(12) United States Patent
Hagemann et al.

(10) Patent No.: US 6,403,296 B1
(45) Date of Patent: Jun. 11, 2002

(54) COLOR PHOTOGRAPHIC SILVER HALIDE MATERIAL

(75) Inventors: Jörg Hagemann, Köln; Markus Geiger, Langenfeld; Heinrich Odenwälder, Leverkusen, all of (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/634,285

(22) Filed: Aug. 9, 2000

(30) Foreign Application Priority Data

Aug. 13, 1999 (DE) ..... 199 38 508

(51) Int. Cl.[7] ..... G03C 1/06

(52) U.S. Cl. ..... 430/607; 430/551; 430/502; 430/543; 430/621; 430/622

(58) Field of Search ..... 430/551, 607, 430/502, 543, 621, 622

(56) References Cited

U.S. PATENT DOCUMENTS

| | | | | |
|---|---|---|---|---|
| RE29,305 | E | 7/1977 | Burness et al. | 430/621 |
| 4,323,646 | A | 4/1982 | Bergthaller et al. | 430/622 |
| 4,568,635 | A | 2/1986 | Yamagami et al. | 430/622 |
| 5,981,160 | A | 11/1999 | Odenwalder et al. | 430/551 |
| 6,284,447 | B1 | 9/2001 | Ly et al. | 430/551 |

*Primary Examiner*—Geraldine Letscher
(74) *Attorney, Agent, or Firm*—Connolly Bove Lodge & Hutz LLP

(57) ABSTRACT

A color photographic silver halide material containing gelatine, comprising a support and at least one photosensitive silver halide emulsion layer and at least one non-photosensitive layer, which material contains at least one compound of the formula (I) or (II) and is hardened with a vinylsulfonyl compound (I)

in which $R_1$, $R_2$, $R_3$, m and n have the meanings stated in the description and wherein two residues $R_2$ or $R_3$ may in each case mean a fused carbo- or heterocyclic ring or the compound of the formula I is attached to a polymer chain via one of the residues $R_1$, $R_2$ or $R_3$, (II)

in which $R_{11}$, $R_{12}$, $R_{13}$, $R_{14}$, o and p have the meanings stated in the description wherein two residues $R_{13}$ or $R_{14}$ may in each case mean a fused carbo- or heterocyclic ring or the compound of the formula II is attached to a polymer chain via a residue $R_{13}$ or $R_{14}$, is distinguished by improved storage stability.

16 Claims, No Drawings

COLOR PHOTOGRAPHIC SILVER HALIDE MATERIAL

This invention relates to a colour photographic silver halide material having improved properties.

Practical requirements placed upon DOP scavengers (scavenging reagents for the developer oxidation product) in colour photographic silver halide materials (colour film and colour paper) are:

a) elevated efficiency, i.e. effective avoidance of unwanted co-coupling, b) elevated storage stability, i.e. avoidance of loss of activity by oxidation prior to processing;

c) no impairment of image stability, i.e. in film for example avoidance of post-coupling, in paper for example stability of the dyes to the action of moisture, heat and light.

So-called white couplers or redox-active compounds are used to perform these tasks. Such compounds conventionally comprise pyrazolone couplers having a methyl group at the coupling site or diffusion-resistant hydroquinones, disulfone amido-phenols and N-aryl-N'-acylhydrazines. However, these compounds are incapable of adequately fulfilling practical requirements as described above. Better results are achieved with certain benzofuranones.

However, when these compounds are used, an increase in magenta fog is observed on storage of exposed and processed materials under tropical conditions.

It has surprisingly now been found that said increase in magenta fog disappears if vinylsulfonyl hardeners are used.

The present invention accordingly provides a colour photographic silver halide material containing gelatine, comprising a support and at least one photosensitive silver halide emulsion layer and at least one non-photosensitive layer, which material contains at least one compound of the formula (I) or (II) and is hardened with a vinylsulfonyl compound (I)

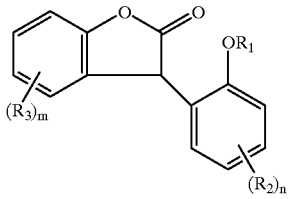

in which $R_1$ means hydrogen, alkyl or acyl, $R_2$, $R_3$ mutually independently mean alkyl, cycloalkyl, alkenyl, aryl, halogen, $OR_4$, $SR_5$, $NR_6R_7$, nitro, cyano, $SO_2R_8$, $COOR_9$, $COR_{10}$ or hetaryl, $R_4$, $R_5$, $R_9$ mutually independently mean alkyl, cycloalkyl, alkenyl, aryl or hetaryl, $R_6$, $R_7$ mutually independently mean H, $R_4$, $COR_{10}$, $COOR_9$, $SO_2R_8$, $R_8$, $R_{10}$ mutually independently mean alkyl, cycloalkyl, alkenyl, aryl, hetaryl or $NR_6R_7$, n, m mean 0, 1, 2, 3 or 4, wherein two residues $R_2$ or $R_3$ may in each case mean a fused carbo- or heterocyclic ring or the compound of the formula I is attached to a polymer chain via one of the residues $R_1$, $R_2$ or $R_3$, (II)

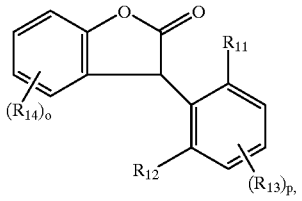

in which $R_{11}$, and $R_{12}$ mutually independently mean alkyl, cycloalkyl, aryl, halogen, $SR_5$, $NR_6R_7$, nitro, cyano, $SO_2R_8$, $COOR_9$, $COR_{10}$, hetaryl or hydrogen and $R_{13}$ and $R_{14}$ mutually independently mean $OR_{15}$ or have the meaning of $R_{11}$, $R_5$, $R_6$, $R_7$, $R_8$, $R_9$ and $R_{10}$ have the above-stated meaning, $R_{15}$ means hydrogen, alkyl or aryl, o means 0, 1, 2, 3 or 4 and p means 0, 1, 2, or 3, wherein two residues $R_{13}$ or $R_{14}$ may in each case mean a fused carbo- or heterocyclic ring or the compound of the formula II is attached to a polymer chain via a residue $R_{13}$ or $R_{14}$.

Acyl residues $R_1$ may be residues of an aromatic or aliphatic carboxylic, carbamic, carbonic, sulfonic, sulfinic or phosphoric acid.

Preferably, at least one of the residues $R_2$ and $R_3$ is in para position relative to the phenolic oxygen.

Incorporation into a polymer chain may proceed via an unsaturated group, for example a styrene, acrylic acid or methacrylic acid group. One suitable monomer of the formula (I) is for example

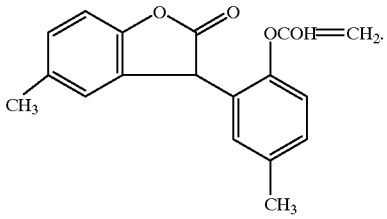

The attachment of the formula I to a polymer may furthermore proceed by means of a polymer-analogous reaction. For example, the following compound

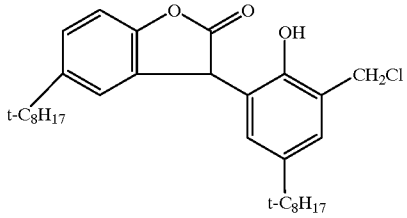

may be attached to a polymer:

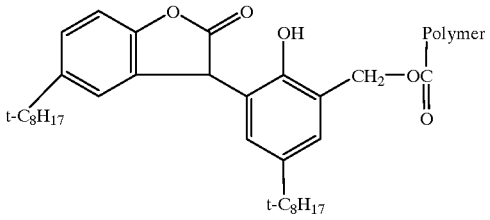

In a preferred embodiment, each $R_2$ is identical to an $R_3$ and n equals m.

Preferably, $R_1$ means hydrogen or acyl, $R_2$ and $R_3$ mean alkyl, wherein the total number of C atoms in the alkyl residues $R_2$ and $R_3$ is ≧8. Preferred acyl residues are the residues of aromatic and aliphatic carboxylic acids. n and m are preferably 1 or 2.

Preferably, $R_{11}$, and $R_{12}$ means hydrogen or alkyl and $R_{13}$ and $R_{14}$ mean alkyl, wherein the total number of C atoms in the alkyl residues $R_{13}$ and $R_{14}$ is ≧8. o and p are preferably 0, 1 or 2.

Examples of compounds of the formula (I), in which $R_1$ is hydrogen, are:

| No. | $R_2$=$R_3$ |
|---|---|
| I-1 | 4-t-$C_4H_9$ |
| I-2 | 4-t-$C_8H_{17}$ |
| I-3 | 4-i-$C_{12}H_{25}$ |
| I-4 | 4-Cyclohexyl |
| I-5 | 2-$CH_3$-4-$CH_3$ |
| I-6 | 2-t-$C_5H_{11}$-4-t-$C_5H_{11}$ |
| I-7 | 2-t-$C_4H_9$-4-$(CH_2)_2CO_2CH_3$ |
| I-8 | 2-t-$C_4H_9$-4-$OCH_3$ |
| I-9 | 2-Cl-4-Cl |
| I-10 | 2-NHCO-i-$C_7H_{15}$-4-O-$COOC_2H_5$ |
| I-11 | 2-$C(CH_3)_2(CH_2)_3CO_2C_2H_5$-4-N 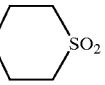 |
| I-12 | 2-$S(CH_2)_{11}CH_3$-4-$CH_3$ |
| I-13 | 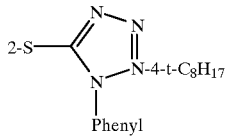 |
| 1-14 | 4-$CO_2C_{12}H_{25}$ |
| I-15 | 3-$CH_3$-4-$CH_3$ |

The position of the substituents is relative to the oxygen. Position is 3 is in para position relative to the $2^{nd}$ ring linkage.

I-16

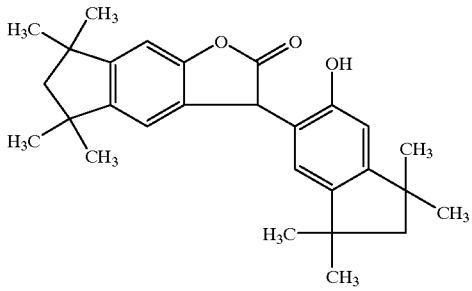

I-17

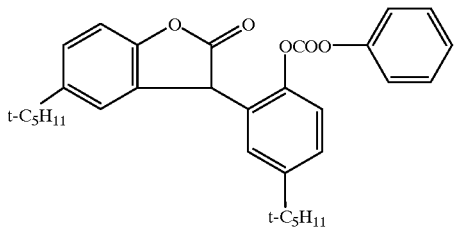

-continued
I-18
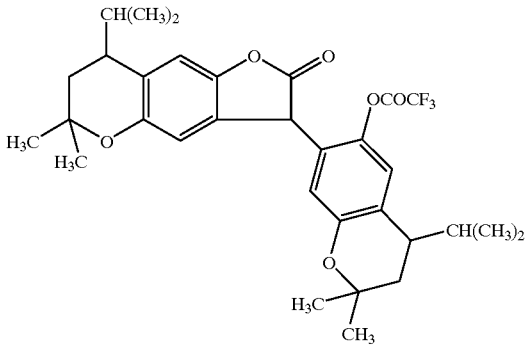
I-19
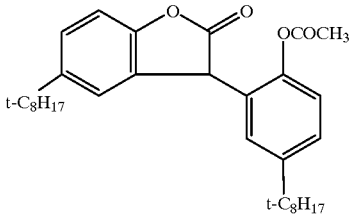
I-20
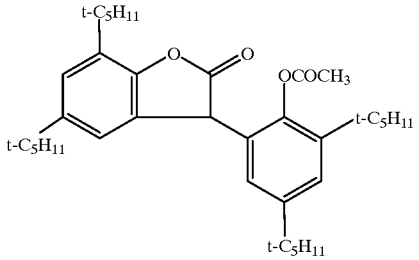
I-21
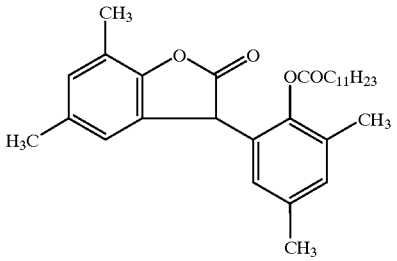
I-22
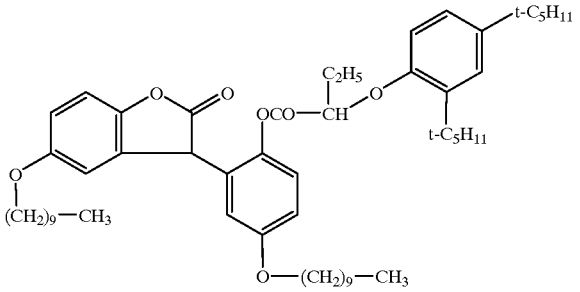

-continued
I-23
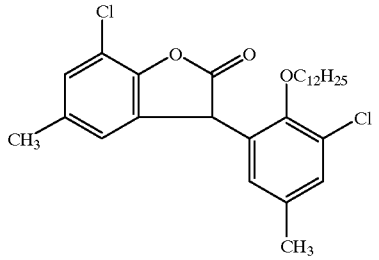
I-24
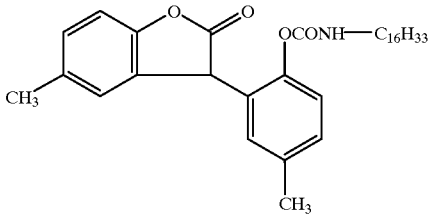
I-25
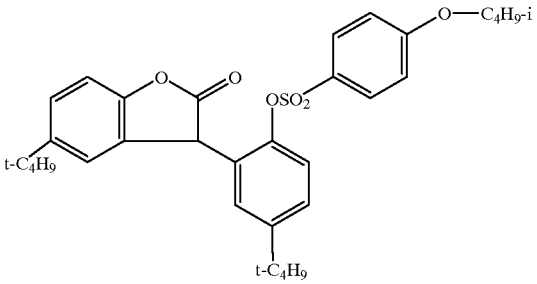
I-26
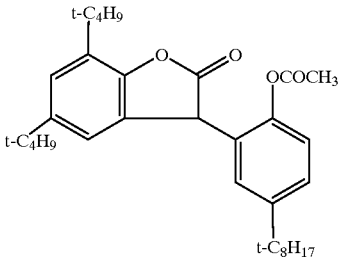
I-27
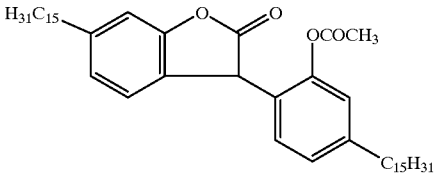
I-28
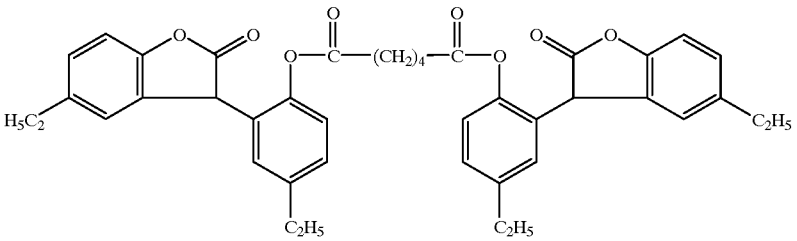

-continued

I-29

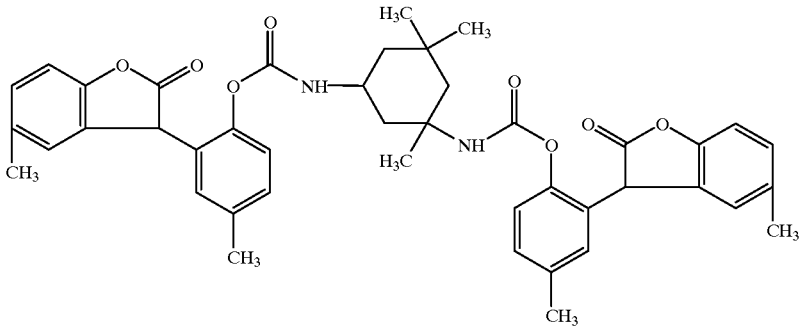

I-30

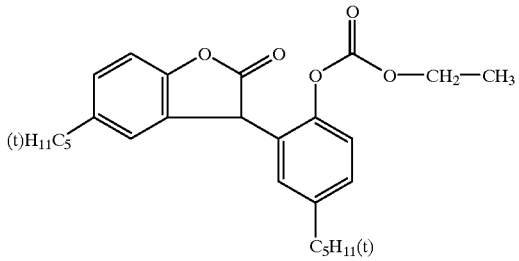

Examples of compounds of the formula (II), in which $R_{11}$, and $R_{12}$ are hydrogen atoms, are:

| No. | $R_{14}$ | $R_{13}$ |
|---|---|---|
| II-1 | 2,4-dimethyl | H |
| II-2 | 2,4-di-tert.-butyl | H |
| II-3 | 4-t-octyl | 3,4-dimethyl |
| II-4 | 2,4-di-tert.-pentyl | 3,4-dimethyl-4-hydroxy |
| II-5 | 2-methyl-4-(2-ethylhexyloxy)-carbonamido | 4-methyl |
| II-6 | 2,4-dicyclopentyl | 3,5-dimethyl-4-acetoxy |
| II-7 | 2,4-di-tert.-butyl | 4-tert.-butyl |
| II-8 | 4-iso-dodecyl (mixture) | H |
| II-9 | 2-methyl-4-tert.-octyl | 4-methoxy |
| II-10 | 2,4-dimethyl | 3,4-diisopropoxy |

-continued

| No. | $R_{14}$ | $R_{13}$ |
|---|---|---|
| II-11 | 2,4-diisononyl | H |
| II-12 | 4-methyl | 3,5-di-tert.-butyl-4-hydroxy |
| II-13 | 2-tert.-butyl-4-methoxy | 3,4-dimethyl |
| II-14 | 3-$C_{15}H_{31}$ | 4-hydroxy |
| II-25 | 4-methyl | 4-iso-$C_{13}H_{27}$—O (mixture) |

The position of the substituents $R_{14}$ is relative to the oxygen, the position of the substituents $R_{13}$ is relative to the linkage site of the phenyl residue.

Further examples are:

II-16

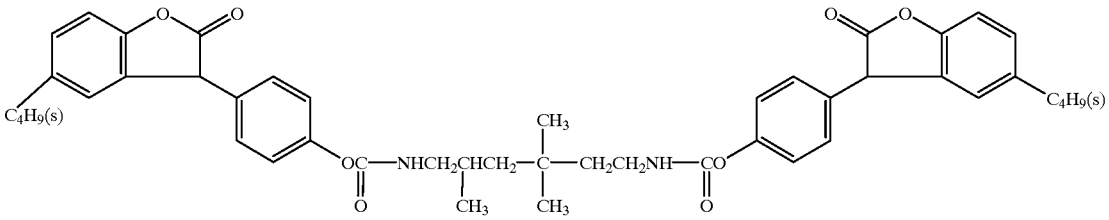

II-17

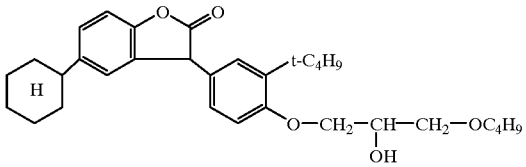

II-18

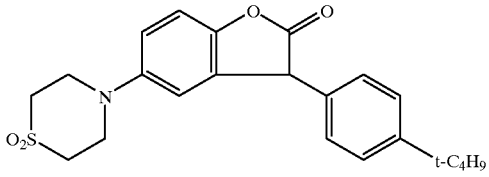

-continued

II-19

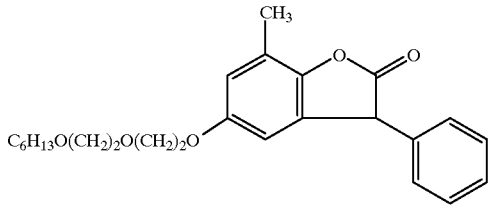

II-20

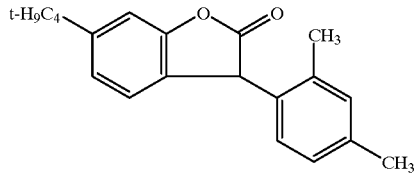

II-21

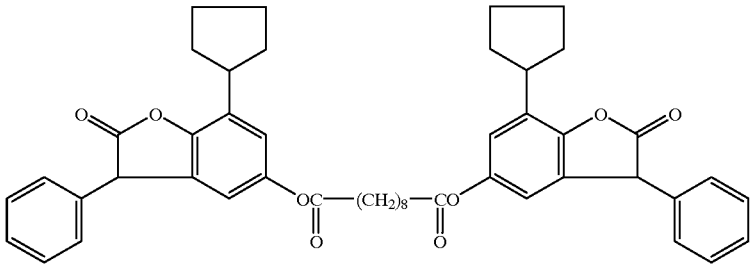

The use of benzofuranones as DOP scavengers is known from EP 871 066. Compounds of the formula II are preferred.

The vinylsulfonyl hardeners are of the formula (III)

$$L—(SO_2—CH=CH_2)_n \quad (III)$$

in which

L means an n-valent group having 1 to 24 C atoms and n means 2, 3 or 4.

L preferably contains 1 to 8 C atoms and n=2.

Suitable vinylsulfonyl hardeners are described in *Research Disclosure* 37254, part 9 (1995), page 294, 37038, part XII (1999), page 82 and 38957, part IIB (1996), page 599.

The vinylsulfonyl hardeners of the formula (III) may also be used in combination with other hardeners described in the above publications and preferably constitute at least 50 mol % of such combinations.

Examples of particularly suitable hardeners of the formula (III) are:

III-1 $CH_2=CH—SO_2CH_2SO_2—CH=CH_2$

III-2 $CH_2=CH—SO_2CH_2CH_2SO_2—CH=CH_2$

III-3 $CH_2=CH—SO_2CH_2OCH_2SO_2—CH=CH_2$

III-4 $CH_2=CH—SO_2CH_2CONHCH_2CH_2NHCOCH_2SO_2—CH=CH_2$

III-5 $CH_2=CH—SO_2CH_2CONH(CH_2)_3NHCOCH_2SO_2—CH=CH_2$

III-6 $CH_2=CH—SO_2CH_2CH(OH)CH_2SO_2—CH=CH_2$

III-7 Reaction product of $C(CH_2SO_2—CH=CH_2)_4$ and $H_2NCH_2CH_2SO_3K$ in a molar ratio of 1.7:1.

The compounds of the formulae (I) and (II) are preferably used in a quantity of 10 to 1000 mg/m$^2$, in particular of 20 to 500 mg/m$^2$, of the layer concerned.

The vinylsulfonyl hardeners are preferably used in a quantity of 0.1 to 5 wt. %, in particular of 0.5 to 2 wt. %, relative to the gelatine.

The compounds of the formula (I) may also be present in salt form (phenolate); suitable cations are metal cations and ammonium ions, in particular alkyl metal ions and trialkyl- or tetraalkylammonium ions.

The compounds of the formula (I) and (II) are in particular used in at least one non-photosensitive layer.

Examples of colour photographic materials are colour negative films, colour reversal films, colour positive films, colour photographic paper, colour reversal photographic paper, colour-sensitive materials for the dye diffusion transfer process or the silver dye bleaching process.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285 and in *Research Disclosure* 38957, part XV (1996), page 627.

The colour photographic materials conventionally contain at least one red-sensitive, one green-sensitive and one blue-sensitive silver halide emulsion layer, optionally together with interlayers and protective layers.

Depending upon the type of the photographic material, these layers may be differently arranged. This is demonstrated for the most important products:

Colour photographic films such as colour negative films and colour reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sublayers are generally arranged closer to the support than the more highly sensitive sublayers.

A yellow filter layer is conventionally located between the green-sensitive and blue-sensitive layers which prevents blue light from penetrating into the underlying layers.

Possible options for different layer arrangements and the effects thereof on photographic properties are described in *J. Inf. Rec. Mats.*, 1994, volume 22, pages 183–193 and in *Research Disclosure* 38957, part XI (1996), page 624.

Colour photographic paper, which is usually substantially less photosensitive than a colour photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in order to increase sensitivity (DE 25 30 645).

The substantial constituents of the photographic emulsion layers are binder, silver halide grains and colour couplers.

Details of suitable binders may be found in *Research Disclosure* 37254, part 2 (1995), page 286 and in *Research Disclosure* 38957, part IIA (1996), page 598.

Details of suitable silver halide emulsions, the production, ripening, stabilisation and spectral sensitisation thereof, including suitable spectral sensitisers, may be found in *Research Disclosure* 37254, part 3 (1995), page 286, in *Research Disclosure* 37038, part XV (1995), page 89 and in *Research Disclosure* 38957, part VA (1996), page 603.

Photographic materials with camera sensitivity conventionally contain silver bromide-iodide emulsions, which may optionally contain small proportions of silver chloride. Photographic print materials contain either silver chloride-bromide emulsions containing up to 80 mol. % of AgBr or silver chloride-bromide emulsions containing above 95 mol % of AgCl.

Details relating to colour couplers may be found in *Research Disclosure* 37254, part 4 (1995), page 288, in *Research Disclosure* 37038, part II (1995), page 80, in *Research Disclosure* 38957, part XB (1996), page 616 and in *Research Disclosure* 40145, part A (1997), page 614. The maximum absorption of the dyes formed from the couplers and the developer oxidation product is preferably within the following ranges: yellow coupler 430 to 460 nm, magenta coupler 540 to 560 nm, cyan coupler 630 to 700 nm. Pyrazolotriazoles are preferably used as the magenta couplers.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290, in *Research Disclosure* 37038, part XIV (1995), page 86 and in *Research Disclosure* 38957, part XC (1996), page 618.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally arranged between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosure* 37254, part 7 (1995), page 292, in *Research Disclosure* 37038, part III (1995), page 84 and in *Research Disclosure* 38957, part XD (1996), page 621.

The photographic material may also contain UV light absorbing compounds, optical brighteners, spacers, filter dyes, formalin scavengers, light stabilisers, anti-oxidants, D, dyes, additives to improve stabilisation of dyes, couplers and whites and to reduce colour fogging, plasticisers (latices), biocides and others.

Suitable compounds may be found in *Research Disclosure* 37254, part 8 (1995), page 292, in *Research Disclosure* 37038, parts IV, V, VI, VII, X, XI and XIII (1995), pages 84 et seq. and in *Research Disclosure* 38957, parts VI, VIII, IX and X (1996), pages 607 and 610 et seq.

The layers of colour photographic materials are conventionally hardened, i.e. the binder used, preferably gelatine, is crosslinked by appropriate chemical methods.

Once exposed with an image, colour photographic materials are processed using different processes depending upon their nature. Details relating to processing methods and the necessary chemicals are disclosed in *Research Disclosure* 37254, part 10 (1995), page 294, in *Research Disclosure* 37038, parts XVI to XXIII (1995), pages 95 et seq. and in *Research Disclosure* 38957, parts XVIII, XIX and XX (1996), pages 630 et seq. together with example materials.

EXAMPLES

Example 1

A colour photographic recording material suitable for rapid processing was produced by applying the following layers in the stated sequence onto a layer support of paper coated on both sides with polyethylene. Quantities are stated in each case per 1 $m^2$. The silver halide application rate is stated as the corresponding quantities of $AgNO_3$.

Layer structure 101

Layer 1: (Substrate layer) 0.10 g of gelatine

Layer 2: (Blue-sensitive layer)

Blue-sensitive silver halide emulsion (99.5 mol % chloride, 0.5 mol % bromide, average grain diameter 0.75 $\mu$m) prepared from 0.4 g of $AgNO_3$, spectrally sensitised with 0.6 mg of compound BS-1

1.25 g of gelatine 0.25 g of yellow coupler GB-1

0.20 g of yellow coupler GB-2

0.30 g of tricresyl phosphate (TCP)

0.05 g of stabiliser ST-1

0.05 g of stabiliser ST-2

Layer 3: (Interlayer)

0.10 g of gelatine 0.06 g of DOP scavenger SC-1

0.06 g of DOP scavenger SC-2

0.12 g of TCP

Layer 4: (Green-sensitive layer)

Green-sensitive silver halide emulsion (99.5 mol % chloride, 0.5 mol % bromide, average grain diameter 0.45 $\mu$m) prepared from 0.2 g of $AgNO_3$, spectrally sensitised with 0.12 mg of compound GS-1

1.10 g of gelatine 0.10 g of magenta coupler PP-1

0.10 g of magenta coupler PP-2

0.15 g of stabiliser ST-3

0.20 g of stabiliser ST-4

0.20 g of TCP 0.02 g of isotetradecanol

Layer 5: (UV protective layer)

1.05 g of gelatine 0.20 g of UV absorber UV-1

0.10 g of UV absorber UV-2

0.05 g of UV absorber UV-3

0.06 g of DOP scavenger SC-1

0.06 g of DOP scavenger SC-2

0.15 g of TCP 0.15 g of tris(2-ethylhexyl) phosphate

Layer 6: (Red-sensitive layer)

Red-sensitive silver halide emulsion (99.5 mol % chloride, 0.5 mol % bromide, average grain diameter 0.48 $\mu$m) prepared from 0.28 g of $AgNO_3$, spectrally sensitised with 0.04 mg of compound RS-1 and stabilised with 0.56 mg of stabiliser ST-5

1.00 g of gelatine 0.10 g of cyan coupler BG-1

0.30 g of cyan coupler BG-2

0.30 g of dibutyl adipate 0.10 g of epoxidised soya oil fatty acid butyl ester

Layer 7: (UV protective layer)

1.05 g of gelatine 0.10 g of UV absorber UV-1

0.30 g of UV absorber UV-2

0.05 g of UV absorber UV-3

0.20 g of tris(2-ethylhexyl) phosphate

Layer 8: (Protective layer)

0.90 g of gelatine 0.05 g of optical brightener W-1

0.07 g of polyvinylpyrrolidone 1.20 mg of silicone oil 2.50 mg of spacers of polymethyl methacrylate, average particle size 0.8 $\mu$m 0.30 g of instant hardener H-1

The following compounds are used in Example 1:

GB-1

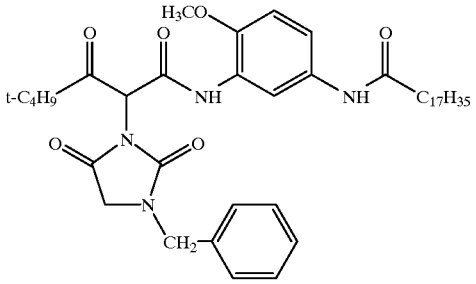

GB-2

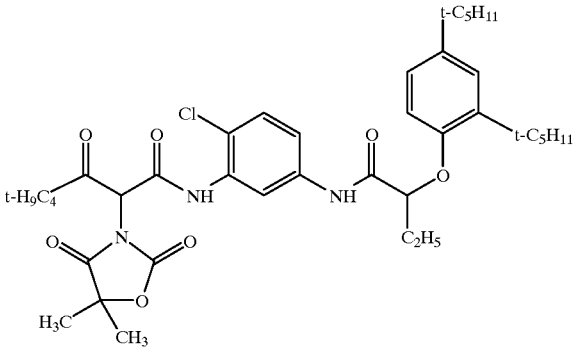

PP-1

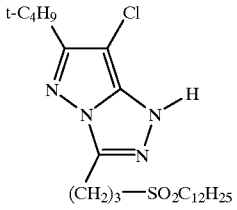

PP-2

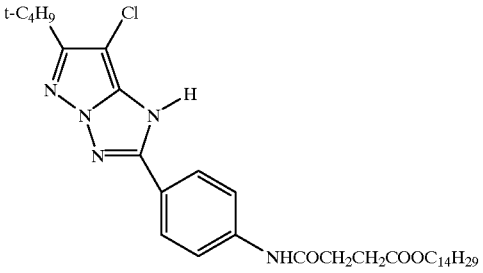

BG-1

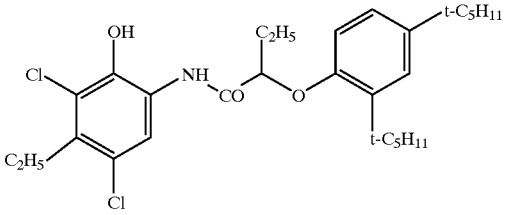

BG-2

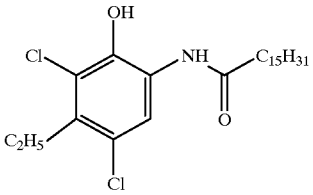

-continued
SC-1
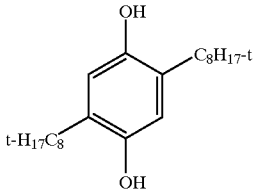
SC-2
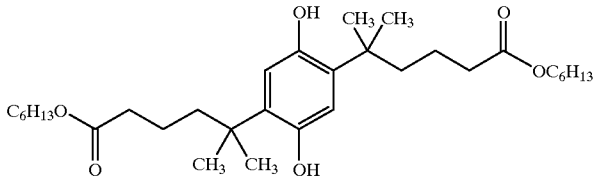
UV-1
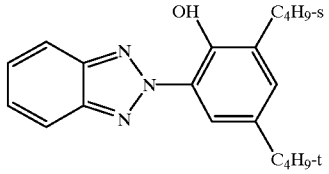
UV-2
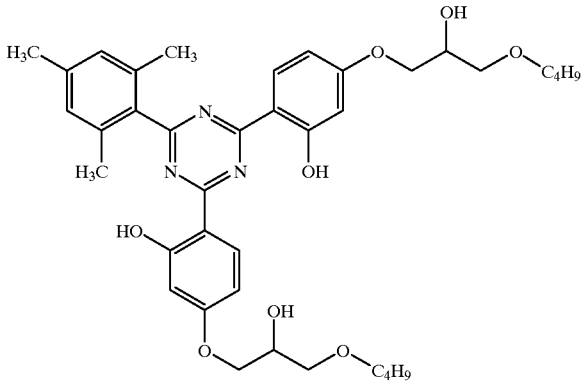
UV-3
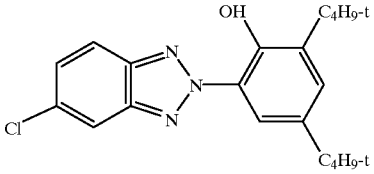
H-1
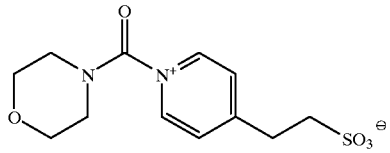
ST-1
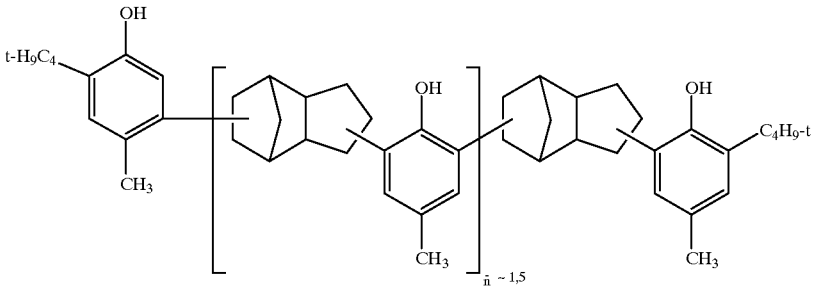
ST-2
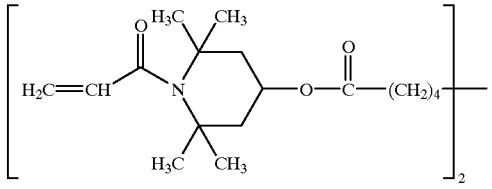
ST-3
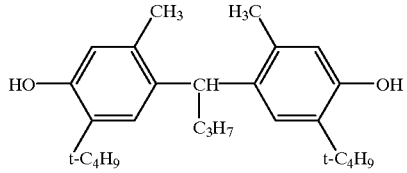
ST-4
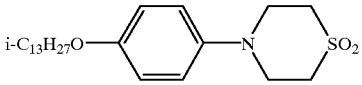
ST-5
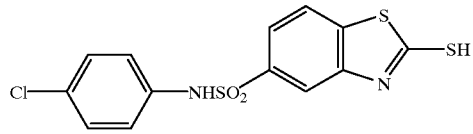

-continued

GS-1

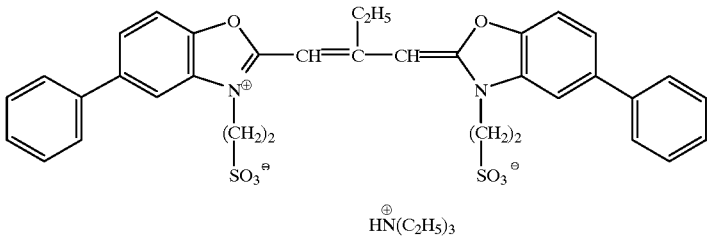

BS-1

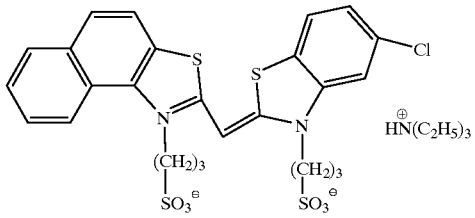

RS-1

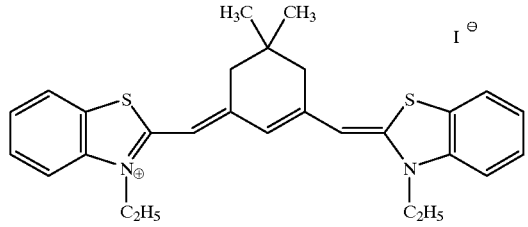

W-1

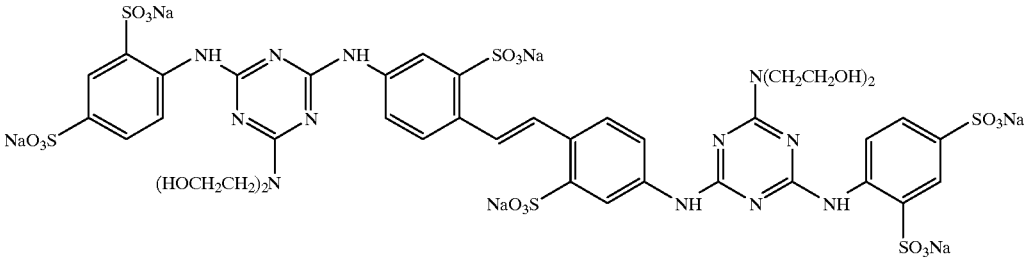

Processing:

A sample of the material is exposed behind a grey wedge in one instance through a blue filter, in another instance through a green filter and in another instance through a red filter and processed as follows; one sample is processed in the unexposed state:

| | | |
|---|---|---|
| a) Colour developer - 45 s - 35° C. | | |
| Triethanolamine | 9.0 | g |
| N,N-Diethylhydroxylamine | 2.0 | g |
| Bis(2-sulfoethyl)hydroxylamine disodium salt | 2.0 | g |
| Diethylene glycol | 0.05 | g |
| 3-Methyl-4-amino-N-ethyl-N-methane-sulfonamidoethyl aniline sulfate | 5.0 | g |
| Potassium sulfite | 0.2 | g |
| Triethylene glycol | 0.05 | g |
| Potassium carbonate | 22 | g |
| Potassium hydroxide | 0.4 | g |
| Ethylenediaminetetraacetic acid disodium salt | 2.2 | g |
| Potassium chloride | 2.5 | g |
| 1,2-Dihydroxybenzene-3,4,6-trisulfonic acid trisodium salt | 0.3 | g |
| make up to 1000 ml with water; pH 10.0 | | |
| b) Bleach/fixing bath - 45 s - 35° C. | | |
| Ammonium thiosulfate | 75 | g |
| Sodium hydrogen sulfite | 13.5 | g |
| Ammonium acetate | 2.0 | g |
| Ethylenediaminetetraacetic acid (iron/ammonium salt) | 57 | g |
| 25% ammonia | 9.5 | g |
| makeup to 1000 ml with acetic acid; pH 5.5 | | |
| c) Rinsing - 2 min - 33° C. | | |
| d) Drying | | |

The cyan and magenta secondary densities (secondary density) of the green- and blue-exposed samples respectively are then determined at magenta density $D_{magenta}$=1.0 ($_{cyan}$-secondary density$_{magenta}$) and at yellow density $D_{yellow}$=1.0 ($_{magenta}$-secondary density$_{yellow}$).

The unexposed sample is also stored for 42 days at 35° C., 90% relative humidity and the change in magenta fog, ($\Delta D_{min(magenta)}$) is determined.

The exposed samples are also exposed to $10\times10^6$1×·h of light from a daylight-standardised xenon lamp in ambient conditions of 35° C., 85% relative humidity. The change in density relative to an initial density of 1.0 is determined ($\Delta D_{yellow}$, $\Delta D_{magenta}$, $\Delta D_{cyan}$).

The results are shown in Table 2.

Layer structures 102–110

Layer structures 102–110 are produced in the same manner as layer structure 101, except that DOP scavengers SC-1 and SC-2 in layers 3 and 5 are replaced with identical quantities of the compounds stated in Table 1 and that the hardener is replaced with that stated in Table 1.

TABLE 1

(C = comparison; I = invention)

| | DOP scavenger in | | Hardener | |
|---|---|---|---|---|
| Layer structure | Layer 3 | Layer 5 | Compound | mg/m$^2$ |
| 101 (C) | SC-1/SC-2 (1:1) | SC-1/SC-2 (1:1) | H-1 | 300 |

TABLE 1-continued (C = comparison; I = invention)

| Layer structure | DOP scavenger in Layer 3 | DOP scavenger in Layer 5 | Hardener Compound | Hardener mg/m$^2$ |
|---|---|---|---|---|
| 102 (C) | SC-1/SC-2 (1:1) | SC-1/SC-2 (1:1) | III-1 | 100 |
| 103 (C) | II-3 | II-3 | H-1 | 300 |
| 104 (C) | II-3 | II-3 | H-2 | 250 |
| 105 (I) | II-20/II-1 (1:1) | II-20/II-1 (1:1) | III-1 | 100 |
| 106 (I) | II-20/II-7 (1:1) | II-20/II-12 (1:1) | III-3 | 100 |
| 107 (I) | II-3 | II-3 | III-5 | 120 |
| 108 (I) | II-3 | II-3 | III-7 | 80 |
| 109 (I) | II-3 | I-19 | III-2 | 100 |
| 110 (I) | I-6 | I-6 | III-1 | 100 |

H-2

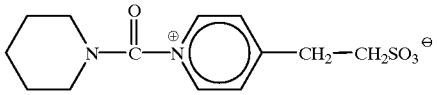

TABLE 2

| Layer structure | Cyan secondary density in magenta: $_{magenta}$-secondary density$_{magenta}$ | Cyan secondary density in yellow: $_{cyan}$-secondary density$_{yellow}$ | Light stability: as change in density in [%] min: yellow $\Delta D_{yellow}$ | magenta $\Delta D_{magenta}$ | cyan $\Delta D_{cyan}$ | Change in fog as optical density after tropical storage $\Delta D_{min(magenta)}$ |
|---|---|---|---|---|---|---|
| 101 (C) | 13.5 | 6.5 | −50 | −71 | −48 | +0.02 |
| 102 (C) | 13.4 | 6.6 | −50 | −72 | −47 | +0.02 |
| 103 (C) | 13.4 | 6.5 | −44 | −36 | −41 | +0.05 |
| 104 (C) | 13.4 | 6.5 | −45 | −36 | −40 | +0.06 |
| 105 (I) | 13.3 | 6.4 | −44 | −35 | −40 | +0.02 |
| 106 (I) | 13.3 | 6.5 | −44 | −37 | −40 | +0.02 |
| 107 (I) | 13.5 | 6.5 | −43 | −37 | −39 | +0.01 |
| 108 (I) | 13.4 | 6.6 | −45 | −36 | −41 | +0.02 |
| 109 (I) | 13.5 | 6.4 | −44 | −36 | −40 | +0.02 |
| 110 (I) | 13.5 | 6.5 | −43 | −36 | −39 | +0.02 |

As Table 2 shows, the hardener selected has no influence upon the properties of the samples when comparison compounds SC-1/SC-2 are used (compare layer structure 101 with 102). Using DOP scavengers according to the invention improves the light stability of the image dyes irrespective of the hardener (compare layer structures 101 and 103 with, for example, 102 and 105). However, when compounds of the formula (I) or (II) are used simultaneously with the comparison compounds H-1 and H-2, there is a prohibitive increase in magenta fog after tropical storage. It is only when, according to the invention, the compounds of the formulae (I) or (II) are used in combination with hardeners of the vinylsulfonyl type (formula (III)) that a material having improved light and tropical stability is obtained.

What is claimed is:

1. A color photographic silver halide material containing gelatine, comprising a support and at least one photosensitive silver halide emulsion layer and at least one non-photosensitive layer, which material contains at least one compound of the formula (I) or (II) and is hardened with a vinylsulfonyl compound (I)

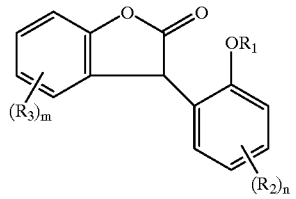

in which $R_1$ means hydrogen, alkyl or acyl, $R_2$ and $R_3$ mutually and independently mean alkyl, cycloalkyl, alkenyl, aryl, halogen, $OR_4$, $SR_5$, $NR_6R_7$, nitro, cyano, $SO_2R_8$, $COOR_9$, $COR_{10}$ or hetaryl, $R_4$, $R_5$ and $R_9$ mutually and independently mean alkyl, cycloalkyl, alkenyl, aryl or hetaryl, $R_6$ and $R_7$ mutually and independently mean H, $R_4$, $COR_{10}$, $COOR_9$ or $SO_2R_8$, $R_8$ and $R_{10}$ mutually and independently mean alkyl, cycloalkyl, alkenyl, aryl, hetaryl or $NR_6R_7$, n and m mutually and independently mean 0, 1, 2, 3 or 4, wherein two residues $R_2$ or $R_3$ may in each case mean a fused carbo- or heterocyclic ring or the compound of the formula I is attached to a polymer chain via one of the residues $R_1$, $R_2$ or $R_3$, (II)

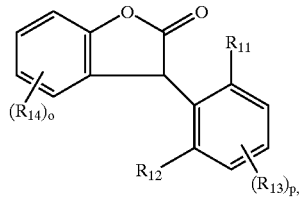

in which $R_{11}$ and $R_{12}$ mutually and independently mean alkyl, cycloalkyl, aryl, halogen, $SR_5$, $NR_6R_7$, nitro, cyano, $SO_2R_8$, $COOR_9$, $COR_{10}$, hetaryl or hydrogen and $R_{13}$ and $R_{14}$ mutually and independently mean $OR_{15}$ or have the meaning of $R_{11}$, $R_5$, $R_6$, $R_7$, $R_8$, $R_9$ and $R_{10}$ have the above-stated meaning, $R_{15}$ means hydrogen, alkyl or aryl, o means 0, 1, 2, 3 or 4 and p means 0, 1, 2, or 3, wherein two residues $R_{13}$ or $R_{14}$ may in each case mean a fused carbo- or heterocyclic ring or the compound of the formula II is attached to a polymer chain via a residue $R_{13}$ or $R_{14}$.

2. Silver halide material according to claim 1, wherein:

$R_1$ means hydrogen or acyl $R_2$ and $R_3$ mutually and independently mean alkyl and n and m mean 1 or 2, and the total number of C atoms in the alkyl residues $R_2$ and $R_3$ is $\geqq 8$.

3. Silver halide material according to claim 1, wherein:

$R_{13}$ and $R_{14}$ mean alkyl and o and p mutually and independently mean 0, 1 or 2 and the total number of C atoms in the alkyl residues $R_{13}$ and $R_{14}$ is $\geqq 8$.

4. Silver halide according to claim 1, wherein $R_2$ and $R_3$ or n and m are identical.

5. Silver halide material according to claim 1, wherein the vinylsulfonyl hardener is of the formula (III)

$$L—(SO_2—CH{=}CH_2)_n \quad \text{(III)}$$

in which

L means an n-valent group having 1 to 24 C atoms and n means 2, 3 or 4.

6. Silver halide material according to claim 5, wherein the L contains 1 to 8 C atoms and n is equal to 2.

7. Silver halide material according to claim 1, wherein the compounds of the formulae (I) and (II) are used in a quantity of 10 to 1000 mg/m$^2$ of the layer concerned.

8. Silver halide material according to claim 1, wherein the vinylsulfonyl hardener is used in a quantity of 0.1 to 5 wt. %, relative to the gelatine.

9. Silver halide material according to claim 1, wherein one of the residues $R_2$ and $R_3$ is in the para position relative to the phenolic oxygen.

10. The silver halide material according to claim 1, wherein $R_2$ and $R_3$ are identical and n and m are identical.

11. The silver halide material according to claim 1, wherein $R_{11}$ and $R_{12}$ are identical or different and are hydrogen or alkyl, $R_{13}$ and $R_{14}$ are identical or different and are alkyl and the total number of C atoms in the alkyl residues $R_{13}$ and $R_{14}$ is $\geqq 8$ and o and p are 0, 1 or 2.

12. The silver halide material according to claim 5, wherein L contains 1 to 8 carbon atoms and n is 2.

13. The silver halide material according to claim 5, wherein the vinylsulfonyl hardener of formula (III) is selected from the group consisting of

III-1 $CH_2{=}CH—SO_2CH_2SO_2—CH{=}CH_2$

III-2 $CH_2{=}CH—SO_2CH_2CH_2SO_2—CH{=}CH_2$

III-3 $CH_2{=}CH—SO_2CH_2OCH_2SO_2—CH{=}CH_2$

III-4 $CH_2{=}CH—SO_2CH_2CONHCH_2CH_2NHCOCH_2SO_2—CH{=}CH_2$

III-5 $CH_2{=}CH—SO_2CH_2CONH(CH_2)_3NHCOCH_2SO_2—CH{=}CH_2$

III-6 $CH_2{=}CH—SO_2CH_2CH(OH)CH_2SO_2—CH{=}CH_2$ and

III-7 Reaction product of $C(CH_2SO_2—CH{=}CH_2)_4$ and $H_2NCH_2CH_2SO_3K$ in a molar ration of 1.7:1.

14. The silver halide material according to claim 13, wherein the compounds of formula (I) and formula (II) are used in a quantity of 20 to 500 mg/m$^2$ of the layer concerned.

15. The silver halide material according to claim 14, wherein the vinylsulfonyl hardener is used in the quantity of 0.5 to 2 wt. % relative to the gelatine.

16. The silver halide material according to claim 1, wherein the compounds of the formula (I) and (II) are used in at least one of said at least one non-photosensitive layer.

* * * * *